US007630506B2

(12) United States Patent
Akino

(10) Patent No.: US 7,630,506 B2
(45) Date of Patent: Dec. 8, 2009

(54) CONDENSER MICROPHONE UNIT

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 815 days.

(21) Appl. No.: 11/287,456

(22) Filed: Nov. 28, 2005

(65) Prior Publication Data

US 2006/0115106 A1 Jun. 1, 2006

(30) Foreign Application Priority Data

Nov. 29, 2004 (JP) ..... 2004-343404

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/174; 381/369; 381/178

(58) Field of Classification Search ..... 381/174
See application file for complete search history.

(56) References Cited

U.S. PATENT DOCUMENTS 7,146,016 B2 * 12/2006 Pedersen ..... 381/175

* cited by examiner

*Primary Examiner*—Brian Ensey
*Assistant Examiner*—Matthew Eason
(74) *Attorney, Agent, or Firm*—Manabu Kanesaka

(57) ABSTRACT

The present invention provides a condenser microphone unit that enables stabilization of the conduction between an impedance converter (FET) and a rear pole plate constituting a condenser section. A condenser microphone unit 11 includes a rear pole plate 14 forming a condenser section 12 together with a diaphragm 13, an impedance converter 43 mounted on a printed circuit board 42, and a relay terminal member 32 placed between the rear pole plate 14 and the impedance converter 43 to electrically connect the rear pole plate 14 to the impedance converter 43 via the relay terminal member 32. The rear pole plate 14 and the impedance converter 43 are accommodated in a metal case 52. The conductive elastic material 32 is formed of a combination of a first conductive elastic material 33 that contacts the impedance converter 43 and a second conductive elastic material 34 that contacts the rear pole plate 14. This stabilizes the connection between the rear pole plate 14 and the second conductive elastic material 34.

4 Claims, 2 Drawing Sheets

CONDENSER MICROPHONE UNIT

CROSS-REFERENCE TO RELATED APPLICATION

The present application is based on, and claims priority from, Japanese Application No. JP2004-343404, filed Nov. 29, 2004, the disclosure of which is hereby incorporated by reference herein in its entirety.

TECHNICAL FIELD

The present invention relates to a technique for a unidirectional (primary sound pressure gradient) condenser microphone unit exhibiting a cardioid directivity.

BACKGROUND ART

FIG. 2 is a vertical sectional view of a conventional unidirectional (primary sound pressure gradient) condenser microphone unit (see FIG. 3 of Japanese Patent Application Publication No. 2000-83292).

In FIG. 2, a condenser microphone unit 1 comprises a condenser section 2 consisting of a diaphragm 3 and a rear pole plate 4 arranged opposite each other via a spacer having a predetermined thickness. The condenser section 2 is placed close to a front side of a cylindrically formed metal case 9 on which front acoustic terminal holes 9*a* are located.

The rear pole plate 4 is supported on an insulating pedestal 5 having a rear acoustic terminal hole 5*a*. The rear acoustic terminal hole 5*a* is in communication with a through holes 4*a* formed in the rear pole plate 4, via an acoustic resistance material 5*b* consisting of a felt material or the like.

An impedance converter (FET) 7 mounted on a printed circuit board 6 is housed in a rear opening in the metal case 9. Open edges 9*b* of the metal case 9 are caulked so as to be curled inward to allow the printed circuit board 6 to seal the rear opening.

The impedance converter 7 and the rear pole plate 4 are in a configurational relationship in which they are electrically connected together as a result of a relay terminal member 8 interposed between the impedance converter 7 and the rear pole plate 4; the relay terminal member 8 is composed of a combination of a contact spring material 8*a* and a conductive elastic material 8*b*.

In the condenser microphone unit 1, shown in FIG. 2, the impedance converter 7 and the rear pole plate 4 are electrically connected together via the relay terminal member 8, consisting of the contact spring 8*a* and conductive elastic material 8*b*.

However, a conducting path for the rear pole plate 4 is established only by the point contact of the contact spring 8*a* with the rear pole plate 4. Accordingly, if, for example, sebum adheres to the contact spring 8*a*, the contact with the rear pole plate 4 becomes unstable. This may result in noise or a decrease in sensitivity.

SUMMARY OF THE INVENTION

In view of the above problems, it is an object of the present invention to provide a condenser microphone unit that enables stabilization of the conduction between an impedance converter and a rear pole plate constituting a condenser section.

To accomplish the object, the present invention provides a condenser microphone unit comprising a rear pole plate forming a condenser section together with a diaphragm, an impedance converter mounted on a printed circuit board, and a relay terminal member placed between the rear pole plate and the impedance converter to electrically connect the rear pole plate to the impedance converter via the relay terminal member, the rear pole plate and the impedance converter being accommodated in a metal case, the condenser microphone unit being characterized in that the relay terminal member is formed of a conductive elastic material that contacts both the impedance converter and rear pole plate.

In this configuration, the relay terminal member is formed of the conductive elastic material. This reduces the number of members required and enables the conductive elastic material to contact the rear pole plate at a large number of positions constituting a planar spread. It is thus possible to ensure a stable connection between the conductive elastic material and the rear pole plate. This in turn makes it possible to effectively avoid the occurrence of noise and a decrease in sensitivity resulting from an inappropriate contact.

In a more preferred aspect, the conductive elastic material may be formed of a combination of a first conductive elastic material that contacts the impedance converter and a second conductive elastic material that contacts the rear pole plate.

In this arrangement, the conductive elastic material (relay terminal member) is formed of the combination of the first and second conductive elastic materials, arranged so as to stably contact each other. The second conductive elastic material contacts the rear pole plate at a large number of positions constituting a planar spread to ensure that the first conductive elastic material contacts the impedance converter. This in turn ensures a stable connection between the first conductive elastic material and the impedance converter. It is thus possible to effectively avoid the occurrence of noise and a decrease in sensitivity resulting from an inappropriate contact.

In a more preferred aspect, the second conductive elastic material comprises an acoustic resistance function.

In this arrangement, the second conductive elastic material comprises the acoustic resistance function. This eliminates the need for interposition of a separate acoustic resistance material. The configuration of parts can thus be simplified.

DETAILED DESCRIPTION

Figure 1A:
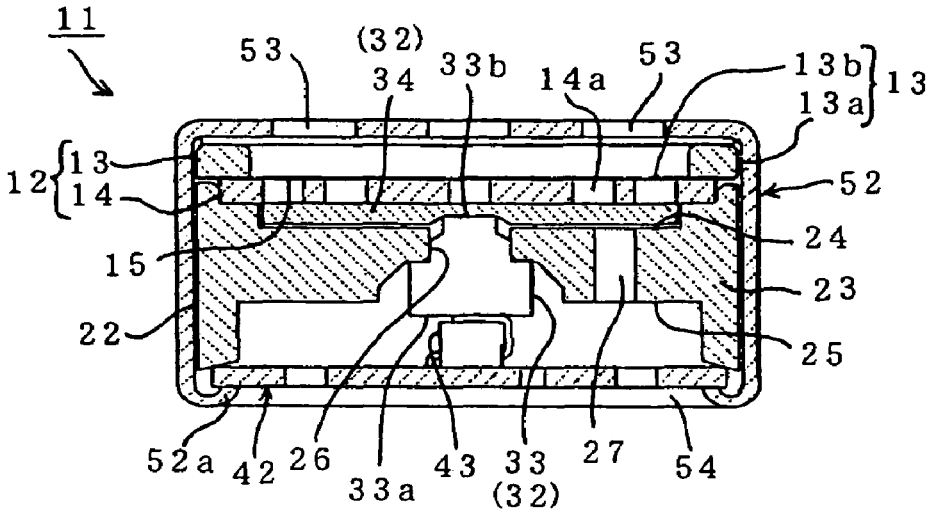
FIG. 1A is a schematic vertical sectional view showing the internal structure of a condenser microphone unit in accordance with an embodiment of the present invention.
Figure 1B:
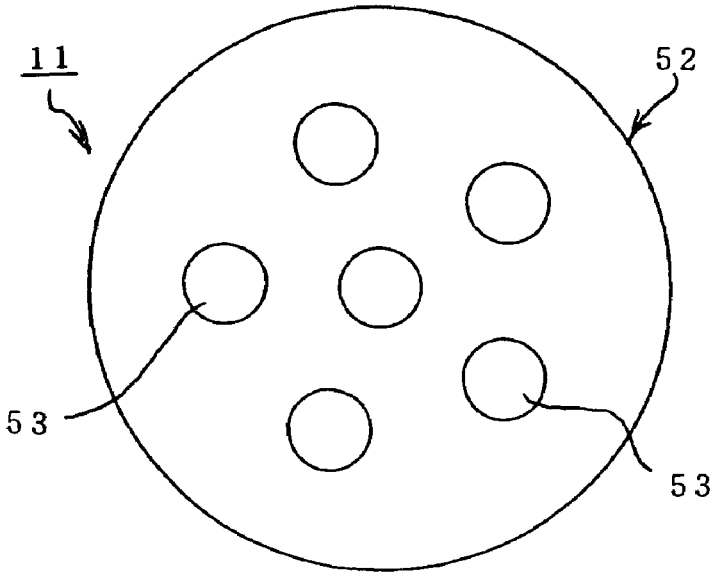
FIG. 1B is a plan view of the condenser microphone unit.
Figure 2:
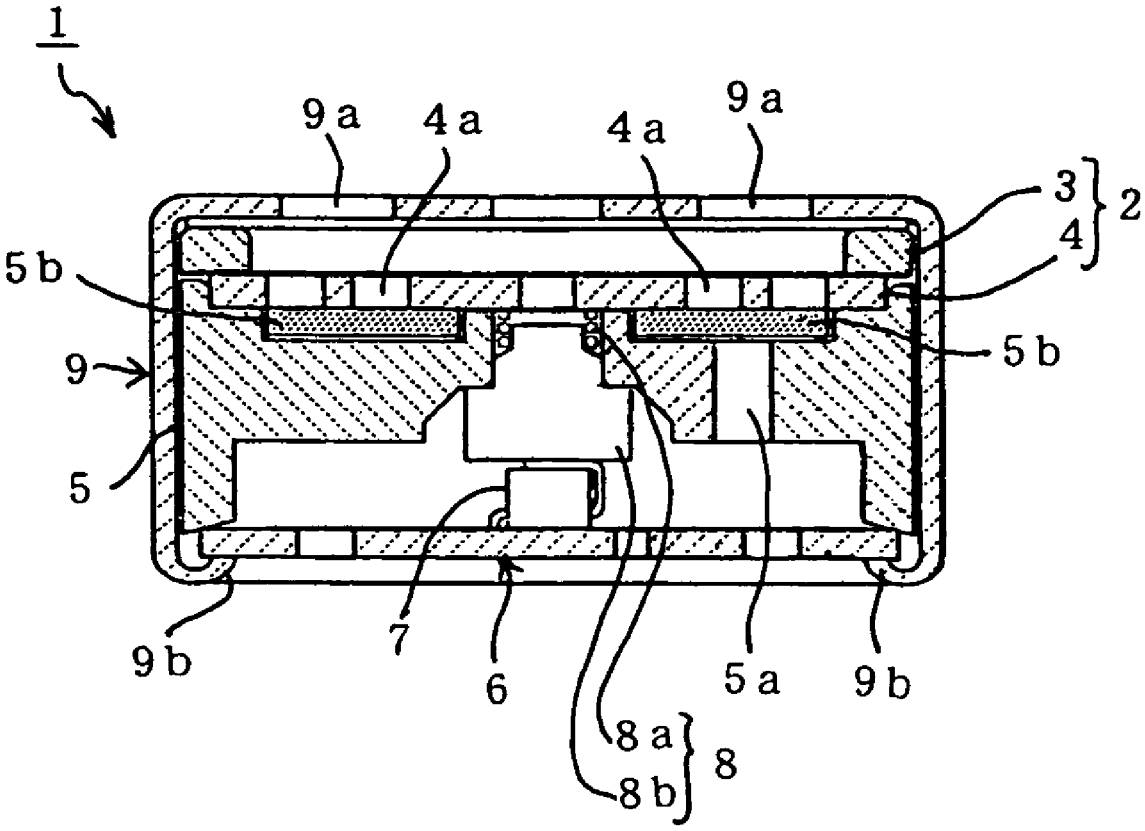
FIG. 2 PRIOR ART
FIG. 2 is a vertical sectional view showing an example of a conventional unidirectional (primary sound pressure gradient) condenser microphone unit.

FIG. 1A is a vertical sectional view showing an example of a condenser microphone unit in accordance with the present invention. FIG. 1B is a plan view of the condenser microphone unit shown in FIG. 1A.

A condenser microphone unit 11 comprises a condenser section 12 and an impedance converter (FET) 43 mounted on a printed circuit board 42; the condenser section 12 and the impedance circuit 43 are accommodated in a cylindrical metal case 52 so as to be electrically connected together.

The condenser section 12 has a diaphragm 13 and a rear pole plate 14 comprising an electret layer; the diaphragm 13 and the rear pole plate 14 are located opposite each other via a spacer 15 having a predetermined thickness. The condenser section 12 is placed close to a front side of the metal case 52 on which front acoustic terminal holes 53 are located. In this case, the diaphragm 13 is formed by extending a vibrating plate 13*b* across holding rings 13*a*.

The rear pole plate 14 consists of a disk having a plurality of through-holes 14*a*. The periphery of the rear pole plate 14 is supported by an insulating pedestal 22. The insulating pedestal 22 comprises a cylindrical main body portion 23, a first concave portion 24 formed in a top surface of the main body portion 23 so as to face the rear pole plate 14, a second concave portion 25 formed in a bottom surface so as to face the printed circuit board 42 on which the impedance converter 43 is mounted, a holding hole 26 formed at a central position of the insulating pedestal 22 so as to penetrate the insulating pedestal 22 between the first concave portion 24 and the second concave portion 25, and a plurality of rear acoustic terminal holes 27 that penetrate the insulating pedestal 22 in the same direction as that in which the holding hole 26 penetrates the insulating pedestal 22.

A first conductive elastic material 33 is held in the holding hole 26 in the insulating pedestal 22. The first conductive elastic material 33 has a lower end surface 33*a* that is in contact with the impedance converter 43 and an upper end surface 33*b* that is in contact with a second conductive elastic material 34 disposed in the first concave portion 24, which faces the rear pole plate 14. The relay terminal member 32 is formed of the combination of the first and second conductive elastic materials 33 and 34.

The second conductive elastic material 34 comprises an acoustic resistance function. In this example, a conductive cloth SUI-78-5010T manufactured by TAIYO WIRE CLOTH CO., LTD. is used as the second conductive elastic material 34. This eliminates the need to provide two different members for an acoustic resistance material and a conductive elastic material.

The impedance converter 43 is in contact with the lower end surface 33*a* of the first conductive elastic material 33. That is, the impedance converter 43 mounted on the printed circuit board 42 is housed in a rear opening 54 in the metal case 52 so as to face the lower end surface 33*a* of the first conductive elastic material 33. An open edge 52*a* of the metal case 52 is caulked so as to be curled inward so that the caulked part presses the printed circuit board 42 to reliably contact the impedance converter 43 with the lower end surface 33*a* of the first conductive elastic material 33.

In this configuration, the condenser section 12 and impedance converter 43, arranged in the metal case 52, are electrically connected together reliably and stably by the relay terminal member 32, interposed between the condenser section 12 and impedance converter 43 and consisting of the first and second elastic materials 33 and 34.

Moreover, the second conductive elastic material 34 is in pressure contact with the upper end surface 33*b* of the first conductive elastic material 33, thus contacting the rear pole plate 14 over a larger area. Accordingly, the second conducive elastic material 34 can always stably contact the rear pole plate 14. This makes it possible to prevent the occurrence of noise and a decrease in sensitivity resulting from an inappropriate contact.

Further, the second conductive elastic material 34 comprises an acoustic resistance function. This enables directivity to be adjusted without the interposition of a separate acoustic resistance material. It is thus possible to reduce the number of components required, thus simplifying the structure.

The present invention has been described on the basis of the illustrated example. The specific configuration of the present invention is not limited to this example. For example, the second conductive elastic material may be formed without the acoustic resistance function. In this case, a conventional acoustic resistance material is provided in place.

Further, the relay terminal member may be formed only of a conductive elastic material, and for example, a corresponding lead terminal drawn out of the relay terminal member may directly contact the impedance converter 43.

The invention claimed is:

1. A condenser microphone unit, comprising:

an insulating pedestal including a main body with a top and bottom surfaces, a first concave portion formed in the top surface, a second concave portion formed in the bottom surface, and a holding hole formed at a center of the main body, a rear pole plate and a diaphragm, forming a condenser section and disposed on the insulating pedestal, a printed circuit board disposed under the main body, an impedance converter mounted on the printed circuit board, and a relay terminal member placed between the rear pole plate and the impedance converter to electrically connect therebetween, said relay terminal member comprising a first conductive elastic material contacting the impedance converter, and a second conductive elastic material formed of a conductive cloth and disposed in the first concave portion to directly entirely contact the rear pole plate on an upper surface thereof, said first conductive elastic material passing through the holding hole and contacting the second conductive elastic material disposed in the first concave portion.

2. The condenser microphone unit according to claim 1, wherein the conductive cloth of the second conductive elastic material has an acoustic resistance function.

3. The condenser microphone unit according to claim 2, wherein the insulating pedestal further includes a plurality of rear acoustic terminal holes, said second conductive cloth covering the plurality of rear acoustic terminal holes.

4. The condenser microphone unit according to claim 3, wherein said impedance converter is disposed in the second concave portion.

* * * * *